US009615986B2

(12) United States Patent
Santinelli Ramos

(10) Patent No.: US 9,615,986 B2
(45) Date of Patent: Apr. 11, 2017

(54) CHIROPRACTIC TABLE

(71) Applicant: Mercedes Santinelli Ramos, Cuajimalpa de Morelos (MX)

(72) Inventor: Mercedes Santinelli Ramos, Cuajimalpa de Morelos (MX)

( * ) Notice: Subject to any disclaimer, the term of this patent is extended or adjusted under 35 U.S.C. 154(b) by 0 days.

(21) Appl. No.: 14/682,633

(22) Filed: Apr. 9, 2015

(65) Prior Publication Data

US 2015/0290063 A1 Oct. 15, 2015

(51) Int. Cl.
*A61G 13/00* (2006.01)
*A61G 13/12* (2006.01)

(52) U.S. Cl.
CPC ..... *A61G 13/009* (2013.01); *A61G 13/121* (2013.01); *A61G 13/1235* (2013.01)

(58) Field of Classification Search
CPC .. A61G 7/00; A61G 7/05; A61G 2007/05784; A61G 7/07; A61G 7/075; A61G 13/1205; A61G 13/121; A61G 13/1225; A61G 13/1235; A61G 13/009
USPC ... 5/600, 620, 632, 630, 633, 635, 731, 733, 5/724, 725
See application file for complete search history.

(56) References Cited

U.S. PATENT DOCUMENTS 2,281,629 A * 5/1942 Snow ..... 5/655
2,715,557 A * 8/1955 Rock ..... 606/242
2,926,660 A * 3/1960 Thompson ..... 606/242
3,747,916 A * 7/1973 Benson ..... 5/600
4,027,888 A * 6/1977 Wilcox ..... 297/452.17
4,206,524 A * 6/1980 Cook ..... 5/630
4,333,638 A * 6/1982 Gillotti ..... 5/613
4,359,245 A * 11/1982 Franke ..... 297/284.1
4,473,913 A * 10/1984 Ylvisaker ..... 5/657
4,665,573 A * 5/1987 Fiore ..... 5/731
4,881,728 A * 11/1989 Hunter ..... 5/622
D353,173 S * 12/1994 Almeda ..... D21/687
5,474,513 A * 12/1995 Carlesimo et al. ..... 482/140
5,795,276 A * 8/1998 Almeda ..... 482/142
6,154,903 A * 12/2000 Wai-Chung ..... 5/632
6,681,770 B1 * 1/2004 Dreher ..... 128/845
D555,741 S * 11/2007 Wachtfogel et al. ..... D21/686
8,555,437 B2 * 10/2013 Gorovitz ..... 5/613
8,671,484 B1 * 3/2014 Logiodice ..... 5/655
2011/0047705 A1 * 3/2011 Gorovitz ..... 5/613
2015/0290063 A1 * 10/2015 Santinelli Ramos A61G 13/009 5/600

* cited by examiner

*Primary Examiner* — Robert G Santos
(74) *Attorney, Agent, or Firm* — Porzio, Bromberg & Newman, P.C

(57) ABSTRACT

Chiropractic table that allows conservation of the natural curves of the spine of a patient using thereof, comprising a continuous curved surface having a concave section at its central portion on the convex side of said curved surface defining first and second convex sections, wherein the ends of the curved surface are in contact with the ends of a frame composed of a plurality of longitudinal straight bar pairs, parallel to each other and which are transversely joined by a plurality of main transverse bars to said longitudinal straight bars, wherein further the first convex section has a greater height then the second convex section with respect to the plane defined by the plurality of longitudinal straight bars and the plurality of main transverse bars.

13 Claims, 3 Drawing Sheets

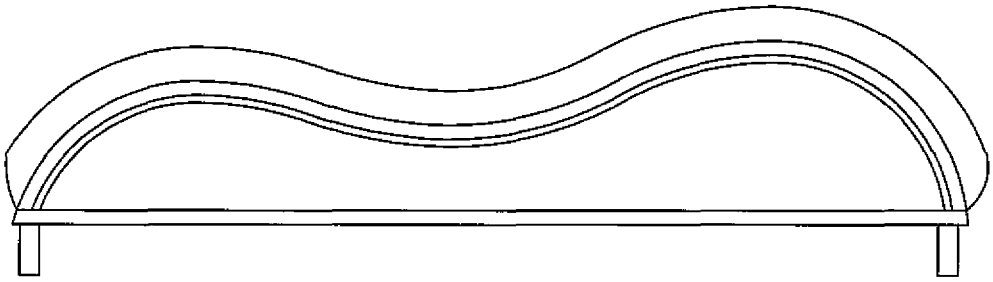
FIGURE 2B
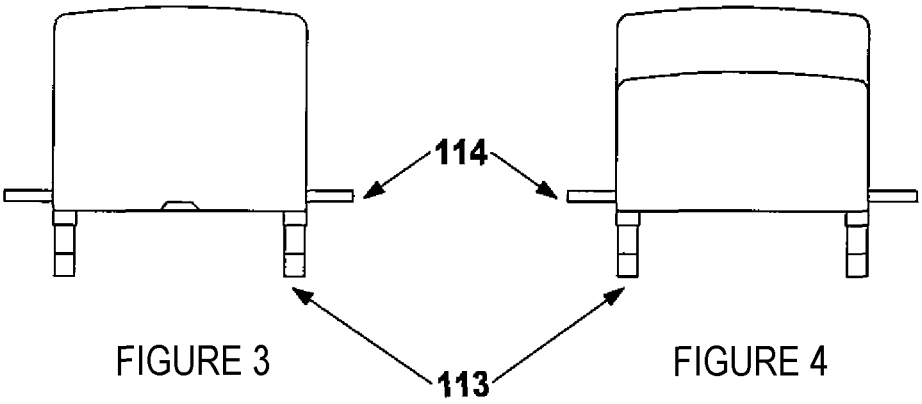
FIGURE 3
FIGURE 4

CHIROPRACTIC TABLE

OBJECT OF THE INVENTION

The present invention refers to a chiropractic table for adjusting vertebral deviations in humans, wherein the shape of the chiropractic and massaging table ensures the conservation of the natural curves of the spine while making spinal adjustment or correction.

BACKGROUND OF THE INVENTION

Currently, there are several devices to try to solve the problems associated with the spine in humans, which are common to all stages of life. Such devices primarily involve certain physical configurations that affect the spine in order to solve problems such as pain, stress, spinal damage, among others.

Chiropractic therapy is a treatment system in which different structures of the body are manipulated, including the spine. This manipulation can be carried out by manual means or using a device.

The relevance of this adjustment table is that it is the only one with curvatures at thoracic and lumbar level leading to the intervertebral discs and facet of the vertebrae of the spine of the patient to be more liberated and higher mobility capacity, and also encourages the paravertebral muscles and paraspinal ligaments to naturally relax avoiding resistance, facilitating the work of the chiropractor using less force to achieve the correct adjustment of the patient's spine; facilitates spinal adjustment in the transition zones between the cervical and thoracic spine, lumbar and thoracic spine, and lumbar and sacral spine, as well as in the upper and lower extremities.

The chiropractic adjustment table of the present invention is the first chiropractic table with a rigid ergonomic design that recreates the primary and secondary natural curvatures of the spine lordotic, kyphotic, hyperlordotic, hypolordotic, hiperkyphotic, and hypokyphotic; the disclosed ergonomic design causes that the intervertebral discs and facets of the vertebrae of the spine of the patient to be more liberated and more capable of mobility, as well as causing the paravertebral muscles and paraspinal ligaments to naturally relax avoiding resistance, thus facilitating the work of the chiropractor using less force to achieve the correct adjustment of the patient's spine; facilitates spinal adjustment in the transition zones between the cervical and thoracic spine, lumbar and thoracic spine, and lumbar and sacral spine, as well as in the upper and lower extremities.

The curvatures of the chiropractic table as well as the weight of the patient's own body favor a soft and natural deeper adjustment, making the chiropractor to use less force by simply following the direction of the facets.

This ergonomic design of rigid natural curvatures of the chiropractic adjustment table, when the patient is in cubitodorsal position, allows that when using soft tissue techniques the result is a faster, deeper and effective relaxation.

This design is suitable for any type of patient, regardless of sex, height, or weight, especially for geriatric patients, which by the very nature of their age are less flexible by dehydration of tissues and discs, as well as to children and adolescents who have not completed their complete ossification, for patients with acute and/or chronic muscle spasms, as in all previous cases the adjustment practiced on this chiropractic adjustment table of rigid curvatures, releases the discs, facets, muscles and ligaments naturally, leading to a better functioning of the central and peripheral nervous system.

The table object of the present invention has been designed to reach a solution to the problem of conserving the natural curves of the spine and thus help to solve the problems thereof, with or without applying chiropractic techniques. For this, the present invention is a surface with three curvatures at different heights (peaks and valleys) and different lengths. The configuration of the three curvatures is in the peak-valley-peak order from one end to another of the table, in the direction of the longitudinal axis thereto.

To complement the description and understanding of the features of the present invention, as an integral part thereof there are included drawings with an merely illustrative but non-limiting purpose in which the following has been depicted:

FIG. 2B is a right side view of another embodiment of the chiropractic and massaging table of the present invention.

FIG. 3 is a front view of one embodiment of the chiropractic and massaging table of the present invention.

FIG. 4 is a rear view of one embodiment of the chiropractic and massaging table of the present invention.

DETAILED DESCRIPTION OF THE INVENTION

The chiropractic and massaging table of the present invention includes a configuration that allows to preserve the natural curves of the spine when making the spinal correction and/or adjustment on a patient placed in prone position (face down). The specific correction and/or adjustment is made in the direction of the facet joints with less strength, higher amplitude and without hyperflexure or hyperextension in the transition zones.

The term "plurality" as used herein refers to an amount of two or more units to which reference is made. The term "table" and "chiropractic table" or "chiropractic and massaging table" are equivalent.

Figure 1:
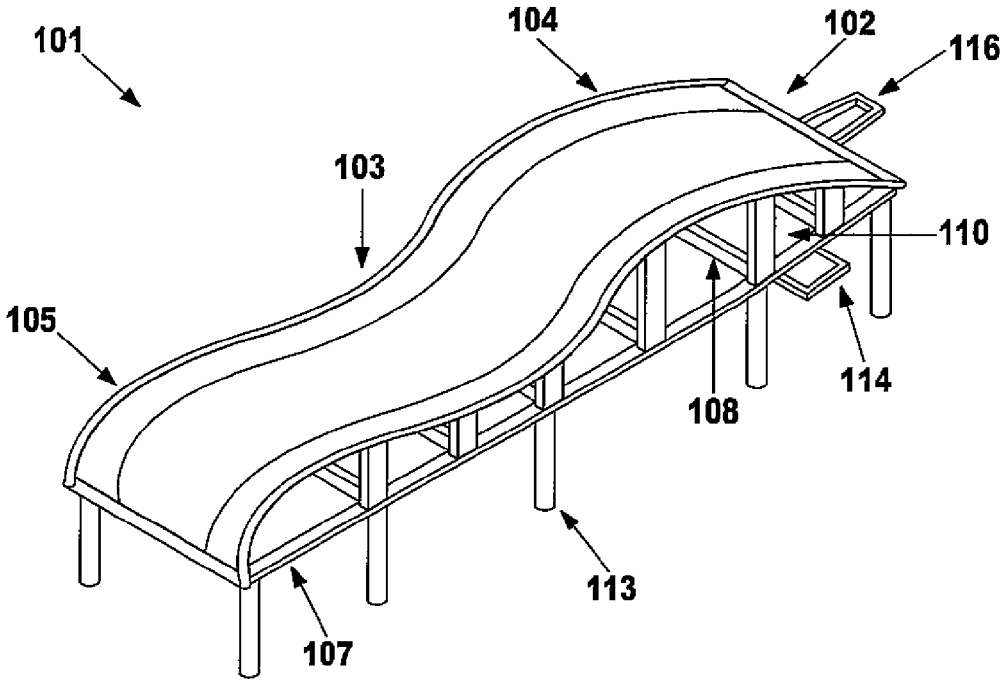
FIG. 1 is a perspective view of an embodiment of the chiropractic and massaging table of the present invention, showing the three curvatures present therein.
Figure 2A:
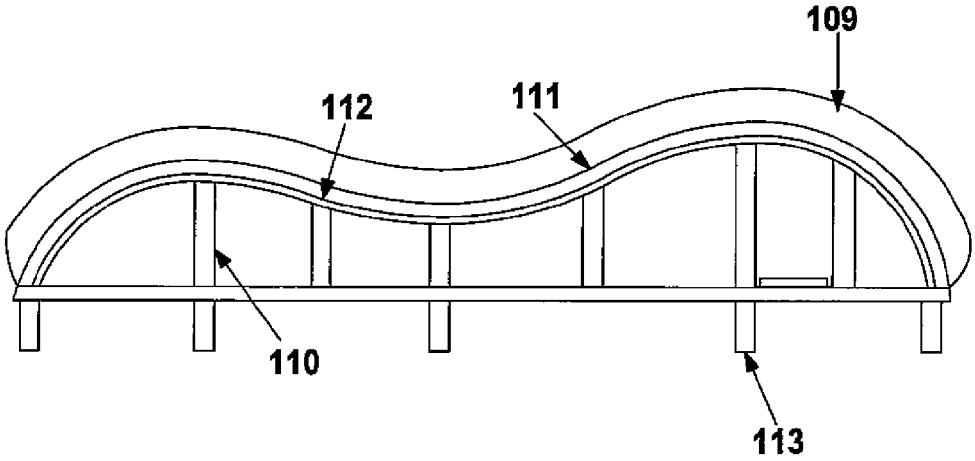
FIG. 2A is a tight side view of one embodiment of the chiropractic and massaging table of the present invention.
Figure 5:
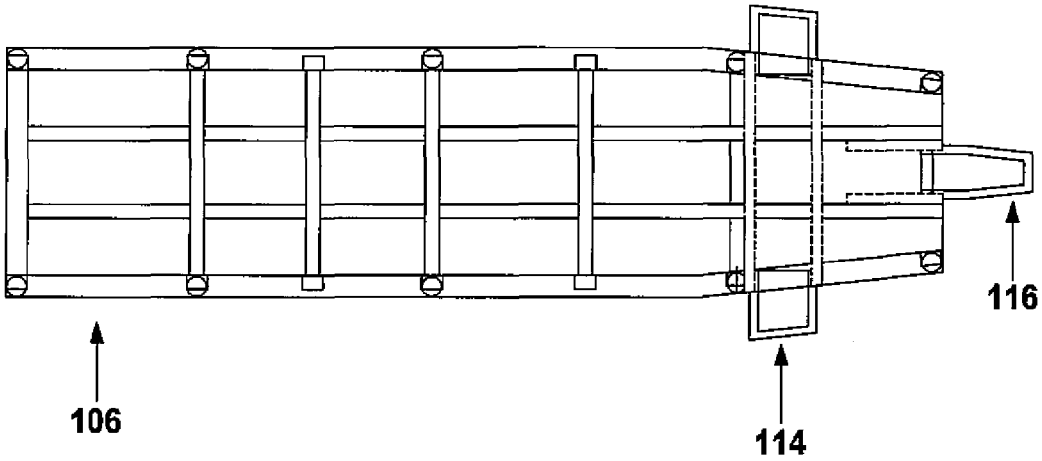
FIG. 5 is a top view of the frame of one embodiment of the chiropractic and massaging table of the present invention.
Figure 6:
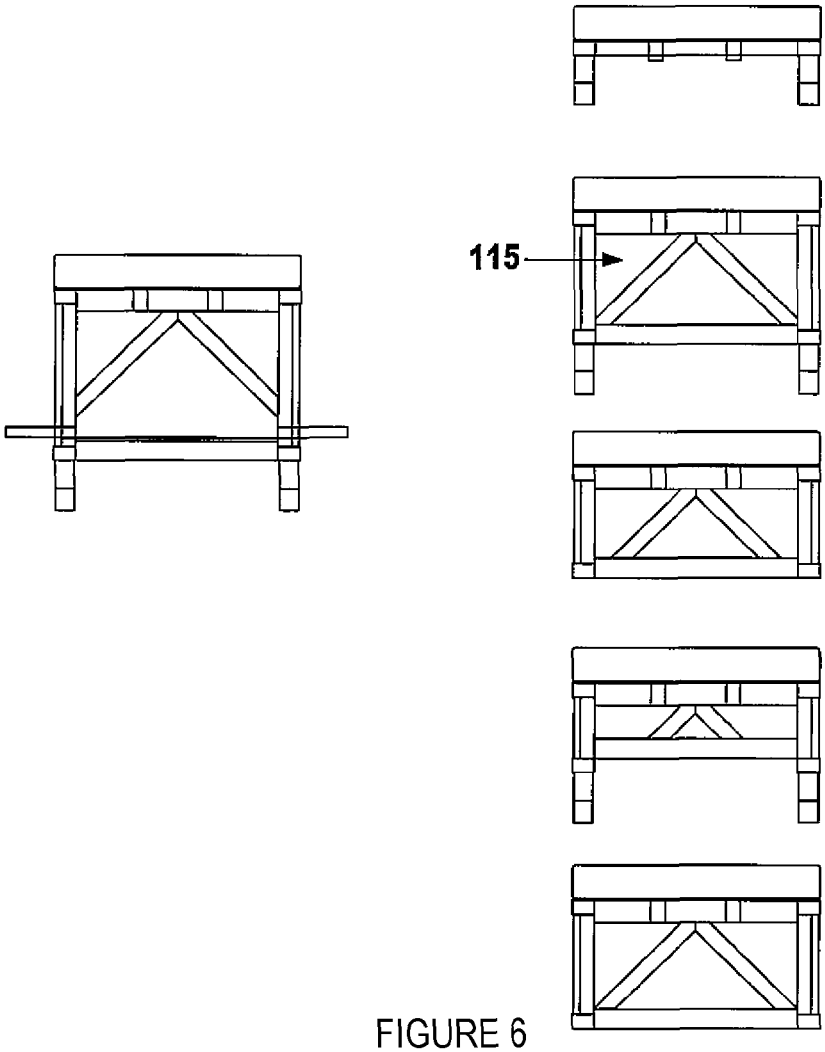
FIG. 6 are cross-sectional views of the lower supports of an embodiment of the present invention.

Referring to FIGS. 1 to 6, the table (101) comprises a continuous curved surface (102) having a concave section (103) in its central part on the convex side of said curved surface (102) defining a first and a second convex sections (104, 105), wherein the ends of the curved surface (102) are in contact with the ends of a frame (106) comprising a plurality of longitudinal straight bar pairs (107) parallel to each other, which are connected transversely by a plurality of main transverse bars (108) to said longitudinal straight bars (107), wherein also the first convex section (104) has a height greater than the second convex section (105) with respect to the plane defined by the plurality of longitudinal straight bars (107) and the plurality of main transverse bars (108).

In one embodiment of the invention, the curved surface (102) having a concave section (103) in its central part on an upper side of said curved surface (102) defining first and second convex sections (104, 105), presents a surface of a deformable material (109) covering at least partially, fully or exceeding the dimensions of said curved surface (102) and is configured with respect to it, on any changes made thereon, as discussed below. The materials suitable as the deformable material (109) comprise polyurethane foams known in the state of the art, for example, but not limited to viscoelastic (memory) foams, closed cell foams, open cell foams.

In one embodiment of the invention, the table has two to ten longitudinal straight bars (107), preferably, the table has two to five longitudinal straight bars (107) and more preferably, the table has two longitudinal straight bars (107). In another embodiment of the invention, the table presents two to twenty main transverse bars (108), preferably from three to eighteen, more preferably four to fourteen and very preferably any punctual amount between five and twelve, that is, five, six seven, eight, nine, ten, eleven, and twelve main transverse bars (108).

In another non-limiting illustrative embodiment of the invention, the table (101) further comprises a plurality of vertical support bars (110) connecting the longitudinal straight bars (107) to the curved surface (102). In a preferred embodiment of the invention, said vertical support bars (110) are located between the ends of the longitudinal straight bars (107) at least at the corresponding points of the peaks (highest point) of the first and second convex sections (104, 105), the valley (point of major depression) of the concave section (103), at a first inflection point (111) formed between the first convex section (104) and the concave section (103), and at a second inflection point (112) formed between the concave section (103) and the second convex section (105). In one embodiment of the invention, the placement of vertical support bars (110) is not limited to the indicated points and may be included elsewhere between the ends of the longitudinal straight bars (107).

In one embodiment of the invention, the table (101) has two to twenty vertical support bars (110), preferably four to eighteen, more preferably six to fourteen, and most preferably any number of vertical support bars (110) between eight and twelve, that is, eight, nine, ten, eleven or twelve vertical support bars (110). Said vertical support bars (110) are most preferably distributed evenly along the longitudinal straight bars (107) that are present.

In a further embodiment of the invention, at least secondary transverse bars (not shown) may be included to bring together at least two vertical support bars (110) in identical configuration to the main transverse bars (108) and keeping a parallel relationship therewith, standing in any position along said vertical support bars (110). Preferably, said secondary transverse bars are positioned in a close position to the curved surface (102).

In one embodiment of the invention, the table has one to five secondary transverse bars, preferably one to three, more preferably one to two and most preferably one secondary transverse bar.

In a further embodiment of the invention, load bars (115) extending diagonally from the intersection between the longitudinal straight bars (107) and the main transverse bars (108) up to meet each other and with the frame (106) are present. The amount of said load bars (115) and locations thereof, find correspondence to the main transverse bars and/or vertical support bars (110).

In another embodiment of the invention, the table (101) has lower supports (113), or legs, that are on or extend in opposed position/direction to the vertical support bars (110), along the longitudinal straight bars (107). Said lower supports (113) serve to stabilize/reinforce the table on the floor, whether or not corresponding to the position of the vertical support bar (110) along the longitudinal straight bars (107). In one embodiment of the invention, the table (101) has an amount of lower supports (113) of four or more, preferably four to twenty, more preferably from six to eighteen and very preferably any even punctual number between eight and sixteen, that is, eight, ten, twelve, fourteen or sixteen. In another embodiment of the invention, the end of each of the lower supports (113) may include a non-skid material, from any materials available for this purpose with a friction coefficient greater than 0.5. Materials in line with the above are, illustratively but not limitative, rubber, polymers, wood and textiles, among others.

In one embodiment of the invention, the table (101) of the invention has a pair of flat projections (114) each extending transversely to the longitudinal straight bars (107), and in an opposite direction each other, both flat projections being at a position within the distance between the ends of the longitudinal straight bars (107) defined by the perpendicular line drawn from the highest point of the first convex section (104) and the end of the bar associated with said first convex section (104). Said flat projections (114) have the function of supporting the arms and/or upper arms and/or hands when a patient is positioned leaning on the table, where his/her thorax and head are on the area of he first convex section (104). In one embodiment of the invention, the first convex section (104) has a cut-out portion (not shown), preferably a parallelogram, most preferably in rectangular shape, which is located between the point of maximum height of the first convex section (104) and the ends of the longitudinal bars associated with said first convex section (104). This cut-out portion is intended to provide a cavity for the face and head of the patient, promoting comfort thereto.

In a further embodiment of the invention, the table (101) includes a front flat platform (116) extending in the same axis of the straight longitudinal bar (107), from the ends of the straight longitudinal bars (107) associated with the first convex section (104). Said front platform (116) is intended to support the patient's head providing comfort when using the table (101).

Suitable materials in any of the embodiments depicted illustratively but not in a limitative way, are as follows: solid metals from the group consisting of steel, preferably stainless steel, carbon steel, alloy steel (with at least one of manganese, nickel, chromium, molybdenum, silicon, sulfur, phosphorus, and combinations thereof), steel for metal construction, wrought iron; wood, derivatives thereof and from cellulose for building structures; solid and rigid plastic polymers from the group consisting of polypropylene, rigid polystyrene, polyethylene (high and low density), polyethylene terephthalate (PET), resins, glass fiber, and any combinations thereof.

The parts of the table that have been described can be joined, illustratively, but not limited to, by known techniques, such as welding, preferably autogenic welding and electric arc welding; by fusing them in the joining zones; by glues based on natural, polymeric, especially epoxy resins; by metal-mechanical fastening parts, such as nuts and bolts, rivets, clamps, among others.

Further embodiments can be achieved by the teachings herein or combination thereof, so they should be covered by the scope herein. Other inherent features of the invention can be seen from the figures.

The invention claimed is:

1. A chiropractic table that allows the conservation of the natural curves of the spine of a patient in use thereof, comprising:

a continuous curved surface of the chiropractic table having a concave section in its central part on the upper side of said curved surface defining first and second convex sections, wherein the ends of the curved surface are in contact with the ends of a frame, said frame comprising a plurality of straight longitudinal bar pairs parallel to each other which are joined transversely by a plurality of main transverse bars to said longitudinal straight bars, wherein further the first convex section adapted to receive upper extremities of a patient has a height greater than the second convex section adapted to receive lower extremities of a patient with respect to the plane defined by the plurality of longitudinal straight bars and the plurality of main transverse bars, a plurality of vertical support bars connecting the longitudinal straight bars with the curved surface and located between the ends of the longitudinal straight bars at least at the points corresponding to the peaks (highest point) of the first and second convex sections, the valley (point of major depression) of the concave section, at a first inflection point formed between the first convex section and the concave section, and at a second inflection point formed between the concave section and the second convex section such that the top ends of the plurality of vertical support bars abut the lower side of the curved surface and a surface of a deformable material covering at least partially, completely or exceeding the dimensions of said curved surface and configured relative thereto.

2. The chiropractic table according to claim 1, wherein the deformable material comprises polyurethane foams selected from the group of viscoelastic (memory) foams, closed cell foams, open cell foams.

3. The chiropractic table according to claim 1, characterized by two to ten longitudinal straight bars, preferably two to five longitudinal straight bars and more preferably, two longitudinal straight bars.

4. The chiropractic table according to claim 1, characterized by two to twenty, preferably from three to eighteen, more preferably four to fourteen and most preferably between five and twelve main transverse bars.

5. The chiropractic table according to claim 1, characterized by two to twenty, preferably four to eighteen, more preferably six to fourteen vertical support bars, and most preferably any number of vertical support bars between eight and twelve, that is, eight, nine, ten, eleven or twelve vertical support bars, said vertical support bars are most preferably distributed evenly along the longitudinal straight bars that are present.

6. The chiropractic table according to claim 1, further including secondary transverse bars identical in configuration to the main transverse bars and keeping a parallel relationship therewith, said secondary transverse bars are in any position along said vertical support bars and preferably are in a close position to the curved surface.

7. The chiropractic table according to claim 6, characterized by having from one to five, preferably one to three, more preferably one to two secondary transverse bars, and most preferably one secondary transverse bar.

8. The chiropractic table according to claim 1, further comprising lower supports, which lie at or extend in opposed position/direction to the vertical support bars, along the longitudinal straight bars.

9. The chiropractic table according to claim 8, characterized in by having an amount of lower supports from four or more, preferably four to twenty, more preferably from six to eighteen and most preferably anywhere from eight and sixteen.

10. The chiropractic table according to claim 1 further including a pair of flat projections each extending transversely to the longitudinal straight bars and in the opposite direction each other, both flat projections being at a position within the distance between the ends of the longitudinal straight bars defined by the perpendicular line drawn from the highest point of the first convex section and the bar end associated to said first convex section.

11. The chiropractic table according to claim 1, further including a front flat platform extending in the same axis of the longitudinal straight bars, from the ends of the longitudinal straight bars associated with the first convex section.

12. The chiropractic table according to claim 1, wherein the first convex section has a cut-out portion, preferably parallelogram-shaped, more preferably rectangular; said cut-out portion is located between the point of maximum height of the first convex section and the ends of the longitudinal bars associated with said first convex section.

13. The chiropractic table according to claim 1, wherein the material of the table is selected from the group of stainless steel, carbon steel, alloy steels, metal construction steel, wrought iron, wood, pulp, plastic polymers, glass fiber and combinations of any thereof.

* * * * *